United States Patent [19]

Giusti

[11] 4,224,824

[45] Sep. 30, 1980

[54] DETECTING DEVICE FOR BREAKS OR TEARS AND FOR THE END OF THE STRIP IN A STRIP OF ANY MATERIAL DURING ITS ADVANCE

[76] Inventor: Giampiero Giusti, 52 Via Barbantini, 55100 Lucca, Italy

[21] Appl. No.: 9,086

[22] Filed: Feb. 2, 1979

[30] Foreign Application Priority Data

Mar. 24, 1978 [IT] Italy ..... 9389 A/78
Oct. 4, 1978 [IT] Italy ..... 51361 A/78

[51] Int. Cl.[3] ..... G01N 33/34
[52] U.S. Cl. ..... 73/159; 340/675
[58] Field of Search ..... 73/159; 340/675

[56] References Cited

U.S. PATENT DOCUMENTS

| | | | |
|---|---|---|---|
| 2,735,329 | 2/1956 | Meuhier | 73/159 |
| 3,037,381 | 6/1962 | Grant | 340/675 |
| 3,502,827 | 3/1970 | Beebe | 340/675 |
| 3,519,922 | 7/1970 | Nash et al. | 340/675 |
| 3,842,668 | 10/1974 | Lippke | 73/159 |
| 4,063,051 | 12/1977 | Gundlach | 340/675 |

FOREIGN PATENT DOCUMENTS

| | | | |
|---|---|---|---|
| 4011 | of 1897 | United Kingdom | 340/615 |

*Primary Examiner*—S. Clement Swisher
*Attorney, Agent, or Firm*—Cushman, Darby & Cushman

[57] ABSTRACT

Device for detecting breaks or tears and the end of the strip in a strip of any material, during its travel, which device comprises, mounted in proximity of the strip and positioned in correspondence with any of its sections which one wishes to explore, and being actuated any time by actuating a push button or the like control member: feeler means apt to feel the material of the strip, so as to follow the changes of direction and/or the oscillations as the strip travels, to feel said material preferably in the sense opposite to the direction of travel of the strip with a push adjustable in function of the limit of the mechanical resistance of the material of the strip, and to penetrate into the tear; and means for detecting the tear and the end of the strip, actuated by such feeler means when the latter penetrate into the cut of the tear or when the end of the strip is reached, said detecting means being capable to be connected to usual control means, so as to transmit to said means the information relative to the occurring of the tear or to the end of the strip so that said control means may consequently control automatically, in due time and at full speed of the strip, the type of necessary intervention required on the strip.

16 Claims, 7 Drawing Figures

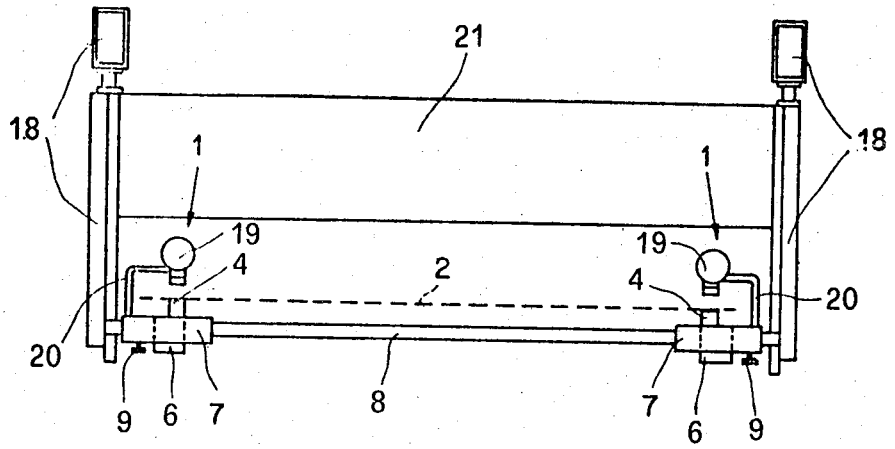
FIG. 5
FIG. 6
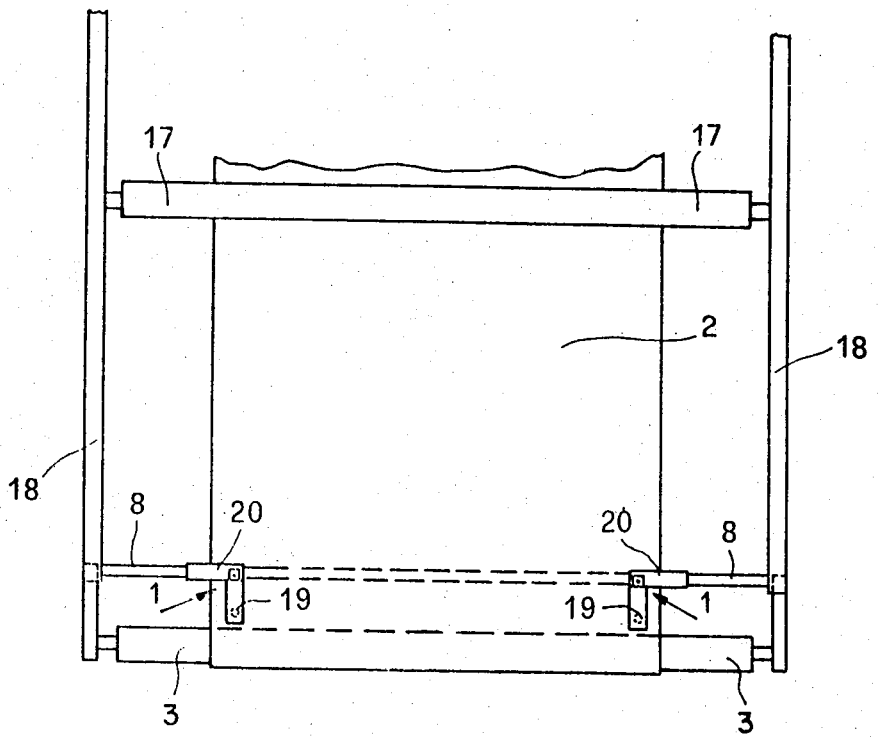

DETECTING DEVICE FOR BREAKS OR TEARS AND FOR THE END OF THE STRIP IN A STRIP OF ANY MATERIAL DURING ITS ADVANCE

The present invention relates to a device for detecting breaks or tears which occur in a strip of any sheet-like material (such as paper, cloth, tin or aluminum foil, plastic, or sheets in general) while such sheet slides and advance on transport means, such as rollers, along a fixed or variable direction.

The detecting devices most commonly used in the processing of paper or of sheet material are of the type utilizing a photocell. Such devices using a photoelectric cell are utilized, in particular, in all those cases where it is necessary to effect the junction at high speed between two strips of paper or, in general, of sheet material. In such cases the photocells are predisposed for the "reading" of the lack of paper or the like and for the subsequent control for the junction or splicing. The automatic junction operation comprises the following two simultaneous steps:

(a) the connection, by means of an adhesive strip, of two strips so that the strips in which the tear occurred can be replaced by the other, which has been predisposed for such reason in the junction zone; and (b) the cutting of the first strip immediately before the junction point.

Once the aforementioned junction operation has been effected, the reel of the torn and replaced strip stops. The part in which the tear has occurred is removed manually and, after having applied at the end of said strip a double-sided strip of adhesive material, said end is fixed onto a preparation bar apt to transport and locate the strip in the position where the junction operation will be performed.

Unfortunately very often, during the unwinding of the strip from the reel, the strip tears laterally, without the possibility that said tear may be "felt," and therefore detected by said photocell, which still "reads" the paper or the like but not the empty space, since the cut or tear has not taken place completely along the entire width of the strip. Meantime the advancing strip continues to tear until a complete break occurs in the successive passages, causing therefore the necessity of stopping the entire production line.

The automatic splicing machines, which realize an automatic junction at a high speed, necessitate of devices for detecting the breaks of the strip and thence for controlling the junction, that is in the case of the tear of the sheet material at the end of the reel from the core carrying said reel and in the case of tear of the strip during the unwinding of said reel; it is however very rare that the material composing the strip detaches itself simultaneously along its entire width or that it tears completely; therefore the known detecting devices very frequently do not give, when on the contrary it would be necessary, the control for the junction, for which control is therefore necessary the intervention of an operator.

It is apparent at this point that such inconveniences greatly reduce the operating efficiency of the production line such as, for example, of one producing corrugated cardboard and result in a notable waste of material.

The object of the present invention is to provide a detecting device for tears or breaks and for detecting the end of the strip which eliminates the above-mentioned inconvenients and puts the joining machine in condition to operate without the intervention of an operator, at full speed, and at any moment and at any diameter of unwinding of the reel at which a break or a tear of the sheet material in question occurs.

The detecting device according to the present invention comprises a fixed support on which the following means can slide and be positioned, in the direction of the width of the sheet which slides and advances:

(a) sensor or feeler means preferably comprising at least a flexible and elastic blade, if necessary of absorbent color and of adjustable length, with one end free and the other mounted on actuating means which push said blade as to feel the strip, so as to follow its changes of direction and/or its oscillations and as to point on the strip in a direction opposite to the moving direction of the same; and (b) means for detecting the tear and the end of the reel comprising at least one member apt to be actuated by said sensor means.

Both the actuating means and the detecting means are actuated by a manual control.

The free end of the flexible blade and the detecting member must be disposed in reciprocal correspondence; in the case of the break of the strip or at the end of said strip, the blade slips into the tear and is pushed into the inside of the same or beyond the end of the strip, actuating the detecting member, which then, through automatic control means, operates the junction of torn or finished strip with a second strip already prepared for this purpose, and the cutting of said first strip before the junction zone.

Although the reaction to said control is almost instantaneous and the junction is effected in few tenths of a second, it results necessary, due to the notable speed at which the strip advances, to mount the aforementioned device at a distance from the junction point established in function of the full speed of the strip and of the detection and control-reaction times.

For a better understanding of the present invention and in order to show how the same may be carried out in practice, reference is now made to the detailed description of some of its illustrative forms of execution with particular reference to the appended drawings in which:

FIG. 5 is a front elevational schematic view, of a frame and of another form of execution of the device;

FIG. 6 is a schematic plan view of FIG. 5; and

Figure 1:
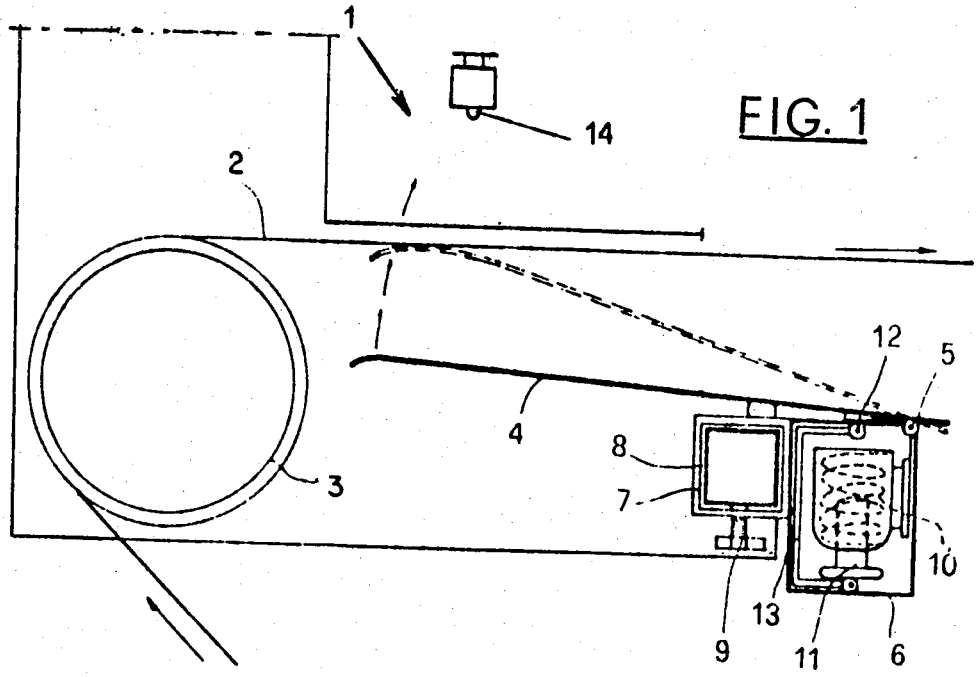
FIG. 1 is a schematic view in vertical section of a first form of execution of the device according to the present invention.

With reference to said figures, there is generally indicated with 1 the device for detecting tears in a strip 2 of any material while it moves on opposite idler rollers, such as that indicated with 3, along an almost fixed direction and, therefore, with an almost constant inclination. In the examples of the figures, such direction of motion is almost horizontal, the direction of motion being indicated with an arrow.

The detecting device 1 has mechanical means apt to feel or sense the material of strip 2, so as to follow its oscillations as it travels, laying on said strip 2 in a direction opposite to that of its travel, with a pressure adjustable as a function of the limit of mechanical resistance of the material of the strip, and finally to penetrate into the cut of the possible tear. Said mechanical means consist essentially of a substantially flat blade 4, flexible and elastic, preferably made of steel or plastic, having one end hinged at 5 on the upper section of a box 6. Said box is fixed on a support 7, which can slide along a horizontal load-bearing bar 8, fixed, below strip 2, to a fixed frame, and which may be locked in the desired position on said bar 8 along the entire width of strip 2, preferably in proximity of each of the two lateral ends of the same. In fact, the tears in correspondence of said edges are practically the only ones which cause interruptions and stoppages in all the production line, since said tears, undergoing continuous tensile stresses, tend to enlarge continuously, up to the point that a complete break of strip 2 occurs. The device 1 is generally applied at a minimal distance from the border of strip 2, corresponding to a critical tear length, below which the tear does not result dangerous. The locking of support 7 to bar 8 may be effected by screw means 9.

The box contains a solenoid 10 which can attract upwardly a member 11, located inside said solenoid 10, any time in which electric current is passed through the solenoid winding. In this manner, member 11 effects an upward push on blade 4 through a small wheel 12 carried by the upper portion of an arm 13, fixed on the lower section of member 11. The blade 4 can thus move as to feel or sense the lower surface of strip 2, applying a slight pressure thereon and pointing thereupon in the direction opposite to the direction of travel thereof, and may penetrate into any tear which occurs on the strip.

Said blade 4 is of adjustable length and has the free end thereof shaped in order not to cause easy breaks while lying on said strip; the degree of the upward stroke effected by member 11 is also adjustable.

It is obvious that one may provide for the mounting of said feeler means above rather than below the strip 2, positioning them along a bar located above rather than below strip 2; this obviously requires the arrangement of the solenoid actuating means so that they push blade 4 downwardly rather than upwardly.

The blade 4 may also be rigid, rather than flexible and elastic but, in such case, ther must be provided apposite elastic means, such as a spring, to connect member 11 to blade 4.

In the detecting device 1 there is realized the pairing of the mechanic feeler means with tear and reel end detecting means, which may be of any type, i.e. present different operating characteristics; said detecting means are mounted in proximity of the strip 2, in a position such that said feeler means, during their movement of penetration into the tear, or movement caused by the ending of the reel, can cause, from said detecting means, the transmission of the detection of said tear or of said end, for example, to an automatic splicing machine.

Figure 2:
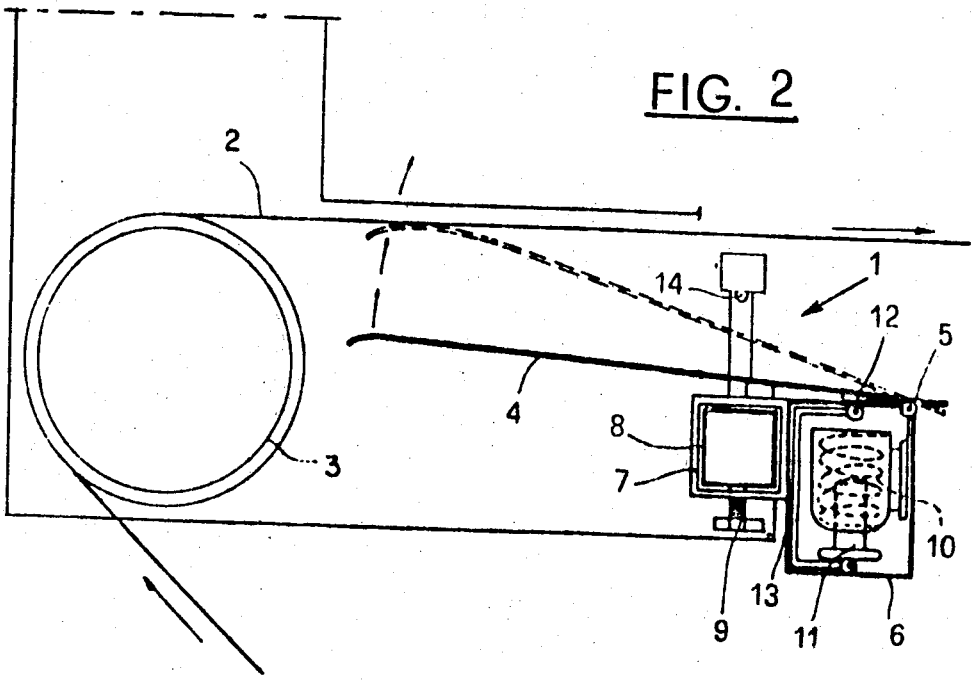
FIG. 2 is a schematic view in vertical section of a variation of the device of FIG. 1.

With reference to FIGS. 1 and 2, to the feeler means there are coupled detecting means of the microswitch type. In FIG. 1 the microswitch 14 is mounted above strip 2 and in a position such that the free end of the blade 4 may press against it during its upward movement of penetration into a tear in the material of said strip 2, or at the end of said reel. Said microswitch 14 may be positioned along the entire width of the strip in correspondence to said free end, preferably near the sides of said strip 2, being carried by said same slidable support 7.

In FIG. 2, the microswitch 14, directly fixed on slidable support 7, is located between the strip 2 and the blade 4 inclined in a position as to feel the strip; the microswitch 14 can thus be pressed by the blade 4 every time that said blade moves upwardly as it penetrates into a tear of the material of strip 2, or at the end of said reel.

Figure 3:
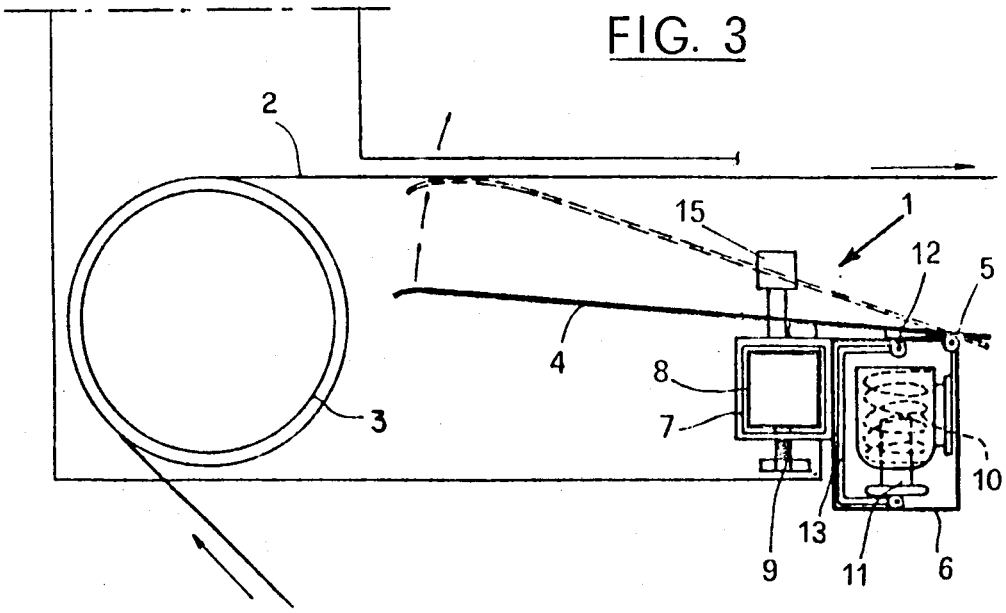
FIG. 3 is a schematic view in vertical section of another form of execution of the device.

With reference to FIG. 3, to said illustrated feeler means there is coupled a detecting instrument of the "proximity" type, represented schematically in said figure and indicated by number 15. Such instrument 15 is fixed onto slidable support 7 and is located below strip 2 near to and correspondingly to blade 4, inclined in a sensing position, so that the latter, being in the detecting field of the instrument 15, during its upward movement effected during the penetration into a tear or a break of the strip material or at the end of said strip, can go out of said field of detection or change it in some manner.

The types of said "proximity" instruments may be:

(a) "capactive," which reveal the presence of any material within an established distance;

(b) "inductive," which reveal only the presence of ferrous materials, always within an established distance;

(c) "magnetic," which reveal only the presence of ferrous materials with the intervention of a counterplate; and (d) "pneumatic," functioning by means of an air column which may be changed by said blade 4 during its upward movement as it penetrates into the tear or at the end of the strip.

Figure 4:
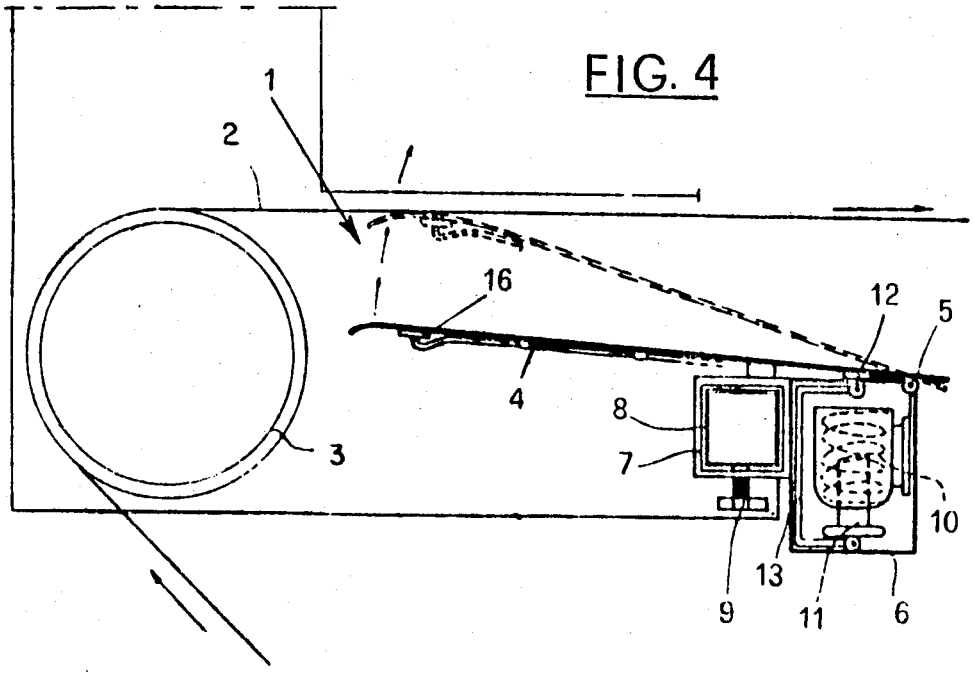
FIG. 4 is a schematic view in vertical section of another variation of the device.

With reference to FIG. 4, to the feeling means illustrated above, there is coupled a miniaturized detecting instrument of the type operating by infra-red rays or light rays, i.e. by photocell. Said instrument, schematized and indicated by 16, is fixed on the lower part of the free end of the blade 4, in correspondence with a hole in said end, so that said rays may pass through it, in order to effect the detection of a tear when said blade 4 penetrates into the latter, moving away and eliminating the material of the strip 2 from the "reading" field of the detecting instrument, which is lifted together with blade 4 as the latter penetrates into the torn section. Naturally, also at the end of the reel, the instrument 16 will no longer read the strip material.

Figure 7:
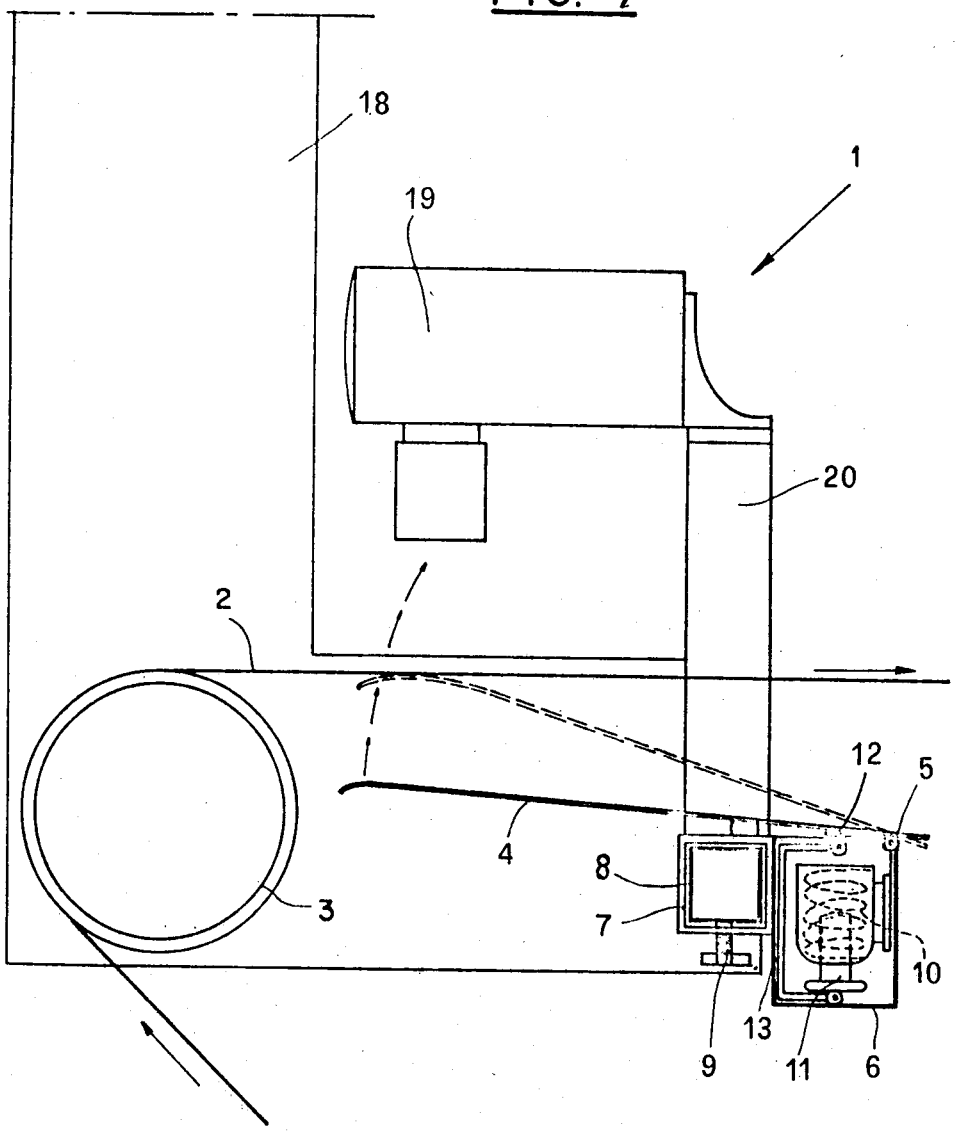
FIG. 7 is a schematic view, in vertical section, on an enlarged scale, of the device of the invention, applied as in FIG. 5.

With reference to FIGS. 5, 6 and 7 the strip 2 (shown with a dashed line in FIG. 5), advances on a idler roller 3 and on another roller 17 of introduction into the junction zone (visible in FIG. 6); the bar 8 is fixed at its ends, to fixed frame 18.

The detecting device comprises a photocell 19, of the reflection type, located above the strip and mounted on an arm 20 fixed below support 7. Said photocell thus "reads" perpendicularly the strip which runs below it.

In the case of tear or at the end of the strip, the blade 4 penetrates into the tear and, anyhow, it is raised as to interfere with the eye of the photocell 19, said blade, in fact, passing above the strip, being on the reading axis of the eye of the photocell 19 does not permit the reflection of the ray emitted (the blade is of an absorbent color; the blade assumes a degree of inclination such as to cause the exit of the reflected ray from the focus of the photocell; the blade, in the fraction of a second, is raised closing, as said above, the eye of the photocell); the photoelectric circuit is thus interrupted causing the sending of the control of the splicing operation to the control system of the automatic splicing machine 21.

The device of the invention presents the following advantages, especially with regard to a production line for corrugated cardboard, equipped with an automatic splicing machine;

(a) a notably smaller waste of material;

(b) an automatic control of the entire length of the reel from which the strip unwinds;

(c) a constant production speed and, therefore, the elimination or the reduction to a minimum of the damages to the material in certain zones of the production line, such as the warping of the cardboard, damages which are due to the interruptions and stops, caused by the tears of the paper; there is obtained, at the same time, a notable increase of the production, due to the unnecessity of slowdowns of the advance of the strip and to the possibility of effecting the junctions at speeds near to the maximum limits of speed of the production line.

(d) the process becomes completely automatic, with the consequent saving of the presence of an operator for controlling the junction;

(e) there are additionally realized economic advantages because of the possibility of using also low quality paper; and (f) the final product results of better quality.

As a variation to the illustrative examples of the present invention, there can be provided another horizontal bar, fixed to the frame above the strip, so as to be able to position on it one or more elements carrying the detection instrument, fixed to a support slidable and fixable along said bar; on the horizontal bar mounted below the strip, there can be positioned the group with the solenoid and with the blade.

The detecting device above illustrated is applied, as it has been said, to a strip which travels in a substantially constant direction. The detecting device is also applicable to a strip which, as it travels, varies continuously its inclination or direction of travel, i.e., for example, on the section of strip travelling towards roller 3, in which section the strip (since it is fed from the below-located reel the diameter of which is progressively reduced) will progressively vary its inclination. Furthermore, the reel can also be mounted for an unwinding in the opposite direction and in such case the inclination of such section of strip will naturally be different from that shown in the drawings. In these cases the detecting device is provided with actuating means apt to move progressively said device (so as to permit it to follow the changes of inclination of the strip while maintaining its optimal operating conditions) as well as to enable it to assume the two different initial positions according to the initial disposition of said section of strip, depending on the aforementioned direction of unwinding of the strip itself. Thus, for example, the blade 4 with the instrument 16 may be mounted at 5 on a shaft which is caused to rotate, by means of suitable mechanical drive, by the stem of a pneumatic cylinder, adjusted so that the free end of the blade 4, once brought in contact and pressed against said section of the strip, follows it uniformly in its variation of inclination, with the elasticity of the blade then taking up in turn the small oscillations of the strip itself. Said stem may operate at the same time a certain number of blades. On the zone of the strip next to each of its two lateral sides there may be mounted some of the blades; another blade may be mounted at the center of the strip.

It is obvious that various other variations may be made by those skilled in the art to the illustrated examples of the present invention, without departing from the spirit of the latter; it is understood that all said variations fall within the field of the invention.

I claim:

1. A device for detecting breaks or tears and the end of the strip in a strip of any material, during its travel and while it is free of contact with a support, which device comprises feeler means for feeling the material of the strip, so as to follow the changes of direction and/or the oscillations thereof as the strip travels, said feeler means pointing in a direction opposite to the direction of travel of the strip and being biased to push against the traveling strip and to penetrate into a tear; and means for detecting the tear and the end of the strip, actuated by said feeler means when the latter penetrate into the cut of the tear or when the end of the strip is reached.

2. A device according to claim 1, wherein said feeler means comprise a flexible and elastic blade which has a free end and wherein said feeler means is biased by a mechanical drive connected with the stem of a pneumatic cylinder which is adjusted so that said free end is moved toward and pressed on the strip.

3. A device according to claim 1, wherein said feeler means comprise a felxible and elastic blade, which has a free end and the other end connected through a hinge to a support, and wherein said feeler means is biased by solenoid means, which push the blade so as to pivot around said hinge so that said blade feels the strip with its free end, with a push which permits it to penetrate into the cut of a tear.

4. A device according to claim 1, wherein said feeler means has a free end which pushes against the traveling strip and wherein said detecting means consist of means of the type operating by light rays, mounted at the end of the feeler means which feels the strip, so that said detecting means may read and detect the presence of the material of the strip which advances in front of them, until said detecting means together with said end of the feeler means penetrate into the cut of the tear or until the end of the strip is reached.

5. A device according to claim 1, wherein said detecting means consist of "proximity" type means having a detection field, which are mounted on the same side of the strip on which said feeler means are located, so that the latter in the movement of penetration into the cut of the tear or at the end of the strip, move away from or alter the detection field of said detecting means.

6. A device according to claim 1, wherein said detecting means include microswitch means mounted in a location such that said microswitch means may be actuated by the feeler means when the latter penetrate into the cut of the tear or at the end of the strip.

7. A device according to claim 1, wherein said detecting means include photocell means, mounted with respect to the strip on the side opposite to that where said feeler means are located, and reading the strip almost perpendicularly, in which case the feeler means, in their movement of penetration into the tear cut or at the end of the strip, actuate said photocell means.

8. A device according to claim 1, wherein pairs of said feeler means and of corresponding detecting means are mounted in proximity of each of the two lateral edges of the strip, with an analogous pair being mounted at the center of the strip.

9. A device as in claim 4 wherein said detecting means are of the type operating with infrared rays.

10. A device as in claim 5 wherein said proximity type means are capacitive means.

11. A device as in claim 5 wherein said proximity type means are inductive means.

12. A device as in claim 5 wherein said proximity type means are magnetic means.

13. A device as in claim 5 wherein said proximity type means are pneumatic means.

14. A device for detecting breaks or tears and the end of a strip of material traveling unsupported along a path in the plane of the strip comprising: a feeler blade having an end portion and being inclined with respect to the path of travel and arranged on one side of said path with said end portion pointing toward said path in the direction opposite to the direction of travel; means mounting and biasing said blade for movement toward said path of travel so that said end portion of said blade will remain in contact with a strip moving along said path and so that said end portion will move to a position on the opposite side of said path of travel upon penetration of said end portion into a tear or upon passage of an end of a traveling strip; and detector means responsive to movement of said end portion of said feeler blade to the opposite side of said path for detecting a tear in a strip traveling along said strip and passage of an end of a traveling strip.

15. A method of detecting breaks or tears and the end of a strip traveling along a path in the plane of the strip comprising biasing a feeler blade having a free end toward one side of the strip in a manner such that the free end of the blade pushes against the strip at a location where the strip is unsupported and such that the free end penetrates into a break or tear and thereby moves to the opposite side of the strip and detecting such movement.

16. A method as in claim 15 wherein the feeler blade is inclined with respect to the strip, with the free end pointing in a direction opposite to the direction of travel of the strip.

* * * * *